US008807457B2

(12) United States Patent
Songbe

(10) Patent No.: US 8,807,457 B2
(45) Date of Patent: Aug. 19, 2014

(54) PUSH-BUTTON FOR A SYSTEM FOR DISPENSING A PRODUCT UNDER PRESSURE

(75) Inventor: Jean-Pierre Songbe, Eu (FR)

(73) Assignee: Albéa le Treport S.A.S (FR)

( * ) Notice: Subject to any disclaimer, the term of this patent is extended or adjusted under 35 U.S.C. 154(b) by 0 days.

(21) Appl. No.: 13/464,303

(22) Filed: May 4, 2012

(65) Prior Publication Data

US 2012/0217322 A1 Aug. 30, 2012

Related U.S. Application Data

(63) Continuation of application No. PCT/FR2010/000726, filed on Nov. 2, 2010.

(30) Foreign Application Priority Data

Nov. 6, 2009 (FR) ..... 09 05366

(51) Int. Cl.
*B05B 1/34* (2006.01)
*B65D 83/20* (2006.01)
*B05B 11/00* (2006.01)

(52) U.S. Cl.
CPC ..... *B05B 1/3436* (2013.01); *B05B 1/3442* (2013.01); *B05B 11/30* (2013.01); *B65D 83/20* (2013.01)
USPC ..... 239/469; 239/463; 239/468; 239/486; 239/490

(58) Field of Classification Search
CPC .... B05B 1/3405; B05B 1/341; B05B 1/3436; B05B 1/3442
USPC ..... 239/463, 468, 469, 486, 490, 491, 492, 239/493, 518, 524
See application file for complete search history.

(56) References Cited

U.S. PATENT DOCUMENTS 3,129,893 A * 4/1964 Green ..... 239/490
4,071,196 A * 1/1978 Burke et al. ..... 239/492

(Continued)

FOREIGN PATENT DOCUMENTS

EP 0412524 A1 2/1991
FR 2915470 A1 10/2008
FR 2927551 A1 8/2009

OTHER PUBLICATIONS

International Search Report; Application No. PCT/FR2010/000726; Issued: Feb. 3, 2011; Mailing Date: Feb. 11, 2011; 1 page.

*Primary Examiner* — Ryan Reis
(74) *Attorney, Agent, or Firm* — St. Onge Steward Johnston & Reens LLC

(57) ABSTRACT

A pushbutton for a system for dispensing a pressurized substance, the pushbutton including a body having a housing provided with an anvil around which a spray nozzle is mounted so as to form a substance dispensing path between the housing and a swirl array including a swirl chamber provided with a dispensing port as well as at least one supply duct for the chamber, the swirl chamber being defined by a side surface having a frusto-conical shape relative to which the supply duct(s) extend(s) in a transverse plane, the side surface tapering from an upstream end into which the downstream end of the supply duct(s) tangentially extends, to a downstream supply opening of the dispensing port, the dispensing port having an outlet size that is equal to the internal size of the downstream opening.

17 Claims, 2 Drawing Sheets

(56) References Cited * cited by examiner

U.S. PATENT DOCUMENTS

| | | | | |
|---|---|---|---|---|
| 4,260,110 | A * | 4/1981 | Werding | 239/404 |
| 5,769,325 | A * | 6/1998 | Jouillat et al. | 239/337 |
| 7,886,995 | B2 * | 2/2011 | Togashi | 239/463 |
| 2009/0057447 | A1 * | 3/2009 | Lowry et al. | 239/601 |

PUSH-BUTTON FOR A SYSTEM FOR DISPENSING A PRODUCT UNDER PRESSURE

CROSS-REFERENCE TO RELATED APPLICATIONS

The present application is a continuation of pending International Patent Application PCT/FR2010/000726 filed on Nov. 2, 2010 which designates the United States and claims priority from French Patent Application 0905366 filed on Nov. 6, 2009, the content of which is incorporated herein by reference.

FIELD OF THE INVENTION

The invention relates to a push-button for a system for dispensing a product under pressure, as well as such a dispensing system.

BACKGROUND OF THE INVENTION

In a particular application, the dispensing system is intended to be provided on bottles used in perfumery, in cosmetics or for pharmaceutical treatments. Indeed, this type of bottle contains a product which is returned by a dispensing system comprising a device for sampling under pressure of said product, said system being actuated by a push-button in order to allow for the spraying of the product. In particular, the system for sampling comprises a pump or a valve with manual actuation by the intermediary of the push-button.

Such push-buttons are conventionally carried out in two portions: an actuator body and a spray nozzle for the product which are associated together to form a vortex unit comprising a vortex chamber provided with a dispensing orifice as well as with at least one supply channel of said chamber.

In particular, the supply channels exit tangentially in the vortex chamber which is cylindrical of revolution in order to rotate the product very rapidly, the dispensing orifice having a reduced diameter in relation to that of said chamber so that the product in rotation escapes through said orifice with a speed that is sufficient to be broken up into droplets forming the aerosol.

However, as this breaking up takes place in an uncontrolled manner, the aerosol is constituted of droplets of highly varied size. For example, for a pump or a valve supplying a push-button with a flow of alcohol under a pressure of 5 bars, and an outlet orifice of 0.3 mm, the aerosol is commonly constituted of droplets of a diameter between 5 μm and 300 μm.

However, the large droplets are heavier than the smallest ones and follow a different dispensing trajectory, which can cause indelible stains in the case of perfumes. Also, the small droplets are the lightest and can be inhaled, which may be the objective sought in the case of medications, but which can be an undesirable effect in the case of toxic products. Furthermore, in the case of medications which must be dispensed according to a precise dosage, the location of application, for example inside the respiratory system, depends on the size of the droplets, and the high disparity of sizes misrepresents the treatment.

Moreover, the size of the droplets coming from a vortex chamber depends in part on the force and on the speed with which the user actuates the pump by pressing on the push-button with his finger, as the induced pressure depends on this.

Furthermore, in particular due to the effects of the centrifugal force at the outlet of the vortex chamber, the aerosol has a tendency to be hollow with a substantially tapered shell which is constituted of most of the droplets although there are few inside the cone. In particular, this distribution of droplets can be detrimental for dermal applications.

It is known moreover, in particular from document FR-2 915 470, a push-button comprising a dispensing chamber which is provided with channels each converging towards an outlet orifice, said converging channels being arranged in order to allow for the impaction of the streams of product dispensed by said orifices. As such, during the impaction of the streams dispensed at high speed, an aerosol is formed without having recourse to a vortex chamber.

However, to produce such an aerosol by satisfactorily controlling the calibration and the spatial distribution of the droplets, it is necessary to form identical streams and of which the convergence is perfect, which is very difficult to carry out industrially at the interface between the actuator body and the nozzle mounted in said body. This results in that the streams can cross without impacting one another or in impacting one another only partially, which degrades the calibration and the spatial distribution of the droplets formed.

Moreover, the supply of the converging conduits or of the vortex chamber according to prior art does not allow for a breaking up of the dose of product to be dispensed, i.e. to return only a portion of the dose provided by the pump. Indeed, the travel of the pressing of the push-button is carried out too quickly, in particular by a magnitude of 0.2 seconds for 120 μl, to be able to be interrupted by the user.

SUMMARY OF THE INVENTION

The invention aims to resolve the problems of prior art by proposing in particular a push-button making it possible to dispense an aerosol formed of droplets having an improved calibration and spatial distribution, and this by increasing the duration of the production of said aerosol.

To this effect, and according to a first aspect, the invention proposes a push-button for a system for dispensing a product under pressure, said push-button comprising a body having a mounting well on a feed tube for the product under pressure and a housing in communication with said well, said housing being provided with an anvil around which a spray nozzle is mounted in such a way as to form a dispensing path for the product between said housing and a vortex unit comprising a vortex chamber provided with a dispensing orifice as well as least one supply channel of said chamber, said vortex chamber being delimited by a lateral surface having a tapered geometry in relation to which the supply channel or channels extend in a transversal plane, said lateral surface converging from an upstream end wherein tangentially exits the downstream end of the supply channel or channels towards a downstream opening for supplying the dispensing orifice, said dispensing orifice has an outlet dimension which is equal to the internal dimension of said downstream opening.

According to a second aspect, the invention proposes a dispensing system for a product under pressure, comprising a system for sampling provided with a feed tube for the product under pressure whereon the well of a push-button is mounted to allow for the spraying of the product.

BRIEF DESCRIPTION OF THE DRAWINGS

Other objectives and advantages of the invention shall appear in the following description, provided in reference to the annexed figures wherein.

DETAILED DESCRIPTION OF THE INVENTION

Figure 1:
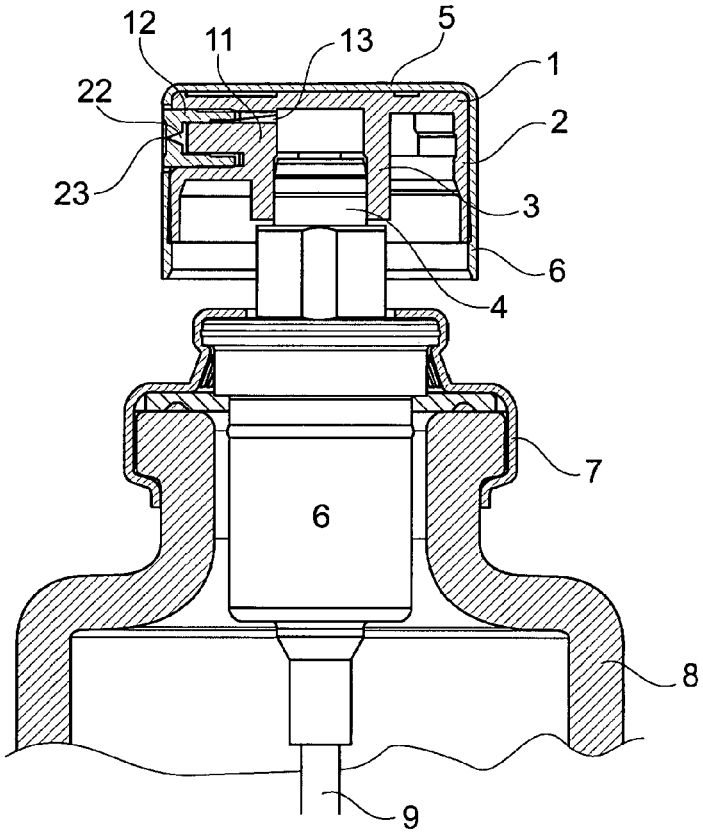
FIG. 1 is a partial longitudinal section view of a bottle provided with a dispensing system according to an embodiment of the invention.
Figure 2:
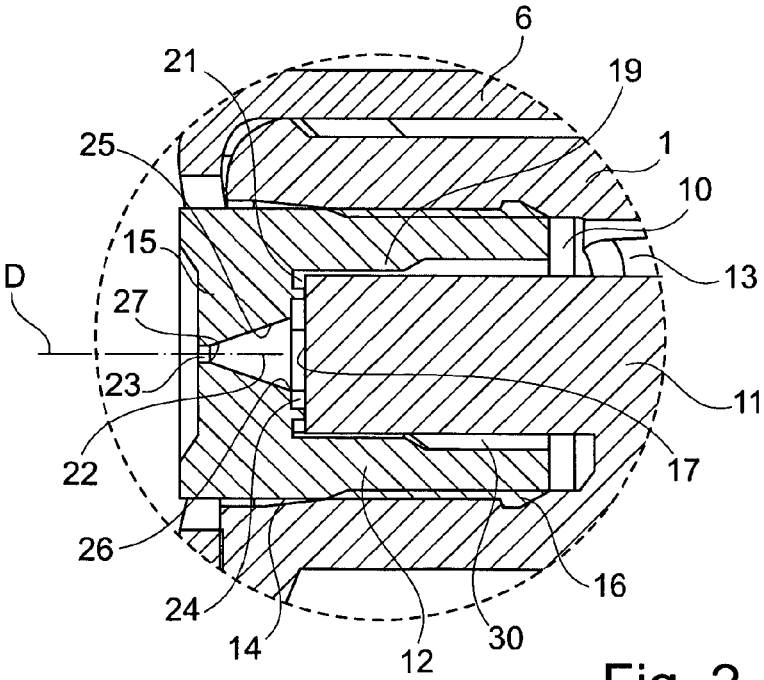
FIG. 2 is a partial longitudinal section view of the push-button of FIG. 1.
Figure 3A:
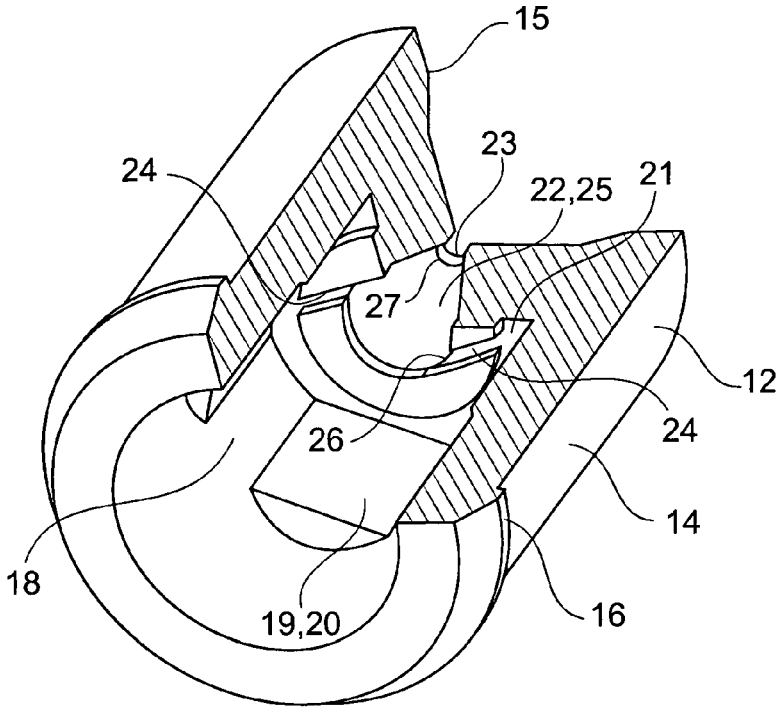
FIG. 3 are views of the nozzle of the push-button according to the FIG. 2, respectively as a cutaway view (FIG. 3*a*) and of the internal portion (FIG. 3*b*).
Figure 3B:
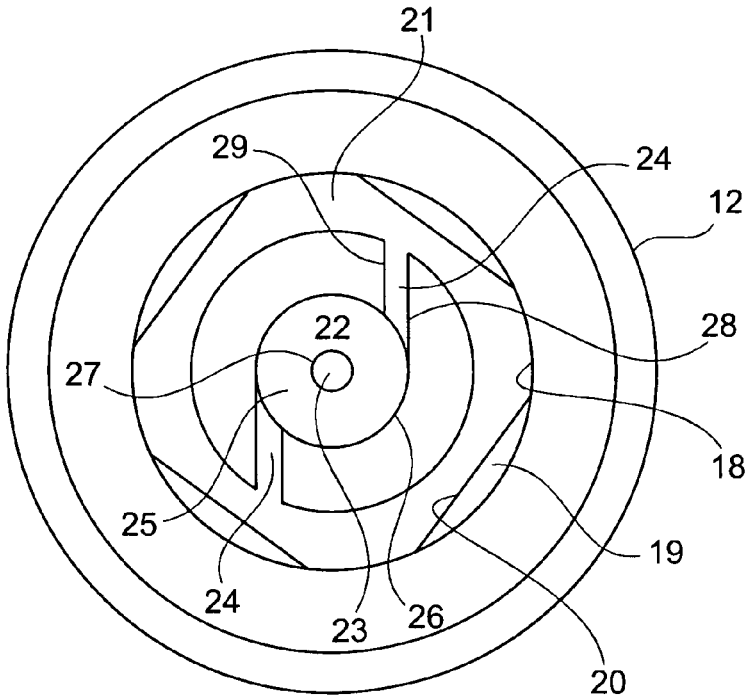

In relation with the figures, a push-button for a dispensing system for a product in particular liquid under pressure is described hereinbelow, said product able to be of any nature, in particular used in perfumery, in cosmetics or for pharmaceutical treatments.

The push-button comprises a body 1 having an annular skirt 2 which surrounds a well 3 for the mounting of the push-button on a feed tube 4 of the product under pressure. Moreover, the push-button comprises an upper zone 5 allowing the user to exert a finger press on said push-button in order to be able to displace it axially. In the embodiment shown, the push-button is provided with a trim 6 for aspect that surrounds the body 1 and whereon is formed the upper zone 5 for pressing.

In relation with FIG. 1, the dispensing system comprises a system for sampling 6 provided with a feed tube 4 of the product under pressure which is inserted in a sealed manner in the well 3. In a known manner, the dispensing system further comprises means for mounting 7 on a bottle 8 containing the product and means for sampling 9 the product inside of said bottle which are arranged to supply the feed tube 4 with product under pressure.

The system for sampling 6 can include a pump with manual actuation or, in the case where the product is conditioned under pressure in the bottle 8, a valve with manual actuation. As such, during a manual displacement of the push-button, the pump or the valve is actuated to supply the feed tube 4 with product under pressure.

The body 1 also has an annular housing 10 which is in communication with the well 3. In the embodiment shown, the housing 10 has an axis perpendicular to that of the mounting well 3 in order to make possible a lateral spraying of the product relatively to the body 1 of the push-button. In an alternative not shown, the housing 10 can be collinear to the well 3, in particular for a push-button forming a nasal spray tip.

The housing 10 is provided with an anvil 11 around which a spray nozzle 12 is mounted in such a way as to form a dispensing path for the product under pressure between said housing and a vortex unit. To do this, the anvil 11 extends from the bottom of the housing 10 by leaving a communication channel 13 between the well 3 and said housing.

In the embodiment shown, the nozzle 12 has a cylindrical lateral wall 14 of revolution which is closed towards the front by a proximal wall 15. The association of the nozzle 12 in the housing 10 is carried out by press fitting of the external face of the lateral wall 14, the rear edge of said external face being furthermore provided with a radial protrusion 16 for anchoring the nozzle 12 in said housing.

Furthermore, a print of the vortex unit is formed in a hollow in the proximal wall 15 and the anvil 11 has a planar distal wall 17 whereon the proximal wall 15 of the nozzle 12 is pressing against in order to delimit the vortex unit between them. In an alternative not shown, a print of the vortex unit can be formed directly on a wall of the housing 10, in particular for a nasal spray tip. In another alternative not shown, the distal wall 17 can have a convexity turned towards the interior of the vortex unit.

Advantageously, the nozzle 12 and the body 1 are carried out by moulding, in particular from a different thermoplastic material. Furthermore, the material forming the nozzle 12 has a rigidity which is higher than the rigidity of the material forming the body 1. As such, the substantial stiffness of the nozzle 12 makes it possible to prevent it from deforming when it is mounted in the housing 10 in such a way as to guarantee the geometry of the vortex unit. Furthermore, the less substantial stiffness of the body 1 allows for an improved seal between the well 3 for mounting and the feed tube 4.

In the example embodiment, the body 1 is made of polyolefin and the nozzle 12 is made of cycloolefin copolymer (COC), poly(oxymethylene) or poly(butylene terephthalate).

In the embodiment shown, the dispensing path has successively in communication from upstream to downstream:

- an upstream annular conduit 30 in communication with the channel 13, said annual conduit being formed between the rear portion of the internal face of the lateral wall 14 of the nozzle 12 and the portion of the external face of the lateral wall of the anvil 11 which is arranged across from it;
- four axial conduits 18 formed between four spacers 19 which extend over the internal face of the lateral wall 14 of the nozzle 12, said spacers having a free wall 20 which is press-fit on the external face of the lateral wall of the anvil 11;
- a downstream annular conduit 21 formed between the proximal wall 15 of the nozzle 12 and the distal wall 17 of the anvil 11.

On the downstream side, the dispensing path supplies with product under pressure the vortex unit which comprises a vortex chamber 22 provided with a dispensing orifice 23 as well as with at least one supply channel 24 of said chamber. More precisely, in the embodiment shown, the supply channels 24 communicate with the downstream annular conduit 21. In particular, this embodiment makes it possible to limit the length of the supply channels 24 in order to reduce the induced head losses.

The vortex chamber 22 is delimited by a lateral surface 25 having a tapered geometry which extends along a dispensing axis D, the dispensing channels 24 extending in a transversal plane in relation to said dispensing axis. In the description, the terms of positioning in space are defined in relation to the dispensing axis.

In the embodiment shown, the tapered geometry is of revolution around the dispensing axis D, an internal dimension of said geometry thus corresponding to a diameter. In an alternative not shown, the tapered geometry can be of polygonal section, an internal dimension of said geometry thus corresponding to a diameter of the shell inscribed in said geometry.

The lateral surface 25 converges from an upstream end 26 wherein exits tangentially the downstream end of the supply channels 24 towards a downstream opening 27 for supplying the dispensing orifice 23. Furthermore, the dispensing orifice 23 has an outlet dimension which is equal to the internal dimension of the downstream opening 27. Advantageously, the angle of convergence of the lateral surface 25 can be between 30° and 50°, in particular of a magnitude of 45°. Moreover, in the embodiment shown, the upstream end 26 has a cylindrical geometry of revolution wherein the downstream end of the supply channels 24 exits tangentially.

As such, during the dispensing of the product under pressure, the tangential supply of the vortex chamber 22 makes it possible to put the product into rotation in the upstream end 26 of said chamber, the product is then thrust and pushed in rotation along the lateral surface 25 of said chamber by forming a pool of product of which the speed of rotation increases and which converges towards the downstream opening 27, then said converging pool can escape through the dispensing orifice 23 without being deformed in such a way as to be able to be impacted to form the aerosol.

This embodiment therefore makes it possible to combine the advantages of the use of a vortex chamber 22 with that of the impaction of the product, without having the disadvantages therein, in particular relatively to the dispersion of sizes of droplets and to the risks of non-impaction of the product. The impaction of the swirling pool makes possible in particular the carrying out of an aerosol formed from a uniform spatial distribution of droplets in suspension in the air, the size of said droplets being small and uniform. In particular, the aerosol can then have the appearance of a plume of smoke with droplet sizes between 10 μm and 60 μm with an average of 35 μm for an alcoholic product, and this regardless of the pressing force that the user exerts on the push-button.

In the embodiment shown, the vortex unit has two supply channels 24 of the vortex chamber 22, said channels being arranged symmetrically in relation to the dispensing axis D.

Moreover, to tangentially supply the vortex chamber 22 by causing the product to turn along its lateral surface 25, each channel 24 has a U-shaped section which is delimited between an exterior wall 28 and an interior wall 29. The exterior wall 28 is tangent to the upstream end 26 and the interior wall 29 is offset from it by a distance less than 30% of the internal dimension of the upstream end 26 in such a way as to avoid an impaction of the product in said upstream end.

In the embodiment shown, the interior wall 29 is parallel to the exterior wall 28. In an alternative not shown, the interior wall 29 has an angle of convergence with the exterior wall 28 in the upstream-downstream direction, the offset between said walls then being measured on the section of exiting of the channels 24 in the upstream end 26.

Alternatively, more than two supply channels 24 can be provided, in particular three channels 24 arranged symmetrically in relation to the dispensing axis D, or a single channel 24 can be provided to tangentially supply the vortex chamber 22.

Moreover, the downstream end of the supply channel 24 or all of the downstream ends of each of the supply channels 24 forms a supply section of the vortex chamber 22. In order to increase the duration of dispensing of a dose of product on the actuating stroke of the push-button, it can be provided that this supply section be low relatively to the interior surface of the upstream end 26. In particular, the surface of the supply section can be less than 10% of the interior surface of the upstream end 26.

Preferentially, the surface of the supply section can be between 0.01 $mm^2$ and 0.03 $mm^2$. In an example embodiment, the internal dimension of the upstream end 26 is 0.6 mm, or an interior surface of 0.28 $mm^2$, and each channel 24 has a width and a depth of 0.1 mm, or a surface of 0.02 $mm^2$ for the supply section. Alternatively, the channels 24 can have a width of 70 μm and a depth of 130 μm.

Furthermore, the fact of the passing of the product in a reduced supply section, the duration of dispensing is increased. For example, for a dose of 120 μl the duration of dispensing can be between 0.5 and 2 seconds in such a way as to allow the possibility for the user to interrupt the dispensing of the aerosol during actuation.

In the embodiment shown, the downstream opening 27 of the vortex chamber is surmounted by a dispensing orifice 23 having a cylindrical geometry of revolution around the dispensing axis D, the internal dimension of said orifice being equal to the internal dimension of the downstream opening 27.

Advantageously, the axial dimension of the dispensing orifice 23 is low in relation to its internal dimension, in such a way as to not disturb the convergence of the swirling pool. In particular, the axial dimension of the dispensing orifice 23 can be less than 50% of its internal dimension.

In an alternative not shown, the downstream opening 27 of the vortex chamber 22 can form a dispensing orifice 23.

The creating of the aerosol is particularly satisfactory when the internal dimension of the downstream opening 27 is low relatively to the internal dimension of the upstream end 26, in such a way that the impaction of the pool is carried out as close as possible to the dispensing orifice 23. In particular, the internal dimension of the downstream opening 27 can be less than 50% of the internal dimension of the upstream end 26, more precisely by being between 20% and 40% of said internal dimension.

Preferentially, the axial dimension of the vortex chamber 22 is relatively substantial, in particular of a magnitude of or greater than the internal dimension of the upstream end 26, in such a way as to allow for the establishment of the swirling pool along the lateral surface 25 of said vortex chamber and to confer a progressive convergence. In particular, the axial dimension of the vortex chamber 22 is at least equal to 80% of the internal dimension of the upstream end 26, more precisely being between 90% and 200% of said internal dimension.

According to a particular embodiment in relation with a product of which the dispensing pressure is between 5 and 7 bars, the internal dimension of the upstream end 26 is 0.6 mm, the internal dimension of the downstream end 27 is less than or equal to 0.24 mm by being in particular between 0.15 mm and 0.24 mm, the axial dimension of the vortex chamber 22 is at least equal to 0.55 mm, the axial dimension of the dispensing orifice 23 is less than 0.10 mm.

What is claimed is:

1. A push-button for a dispensing system for a product under pressure, said push-button comprising:

a body having a well for mounting on a feed tube of the product under pressure; and a housing in communication with said well, said housing including an anvil around which a spray nozzle is mounted in such a way as to form a dispensing path for the product between said housing and a vortex unit, the vortex unit comprising a vortex chamber, including a dispensing orifice, and at least one supply channel of said vortex chamber;

said push-button being characterised in that said vortex chamber is delimited by a lateral surface having a conical geometry and an upstream end to which the at least one supply channel extends in a transverse plane located downstream of the anvil, the plane being perpendicular to a dispensing axis of the vortex chamber, said lateral surface converging from the upstream end, where the product tangentially exits a downstream end of the at least one supply channel to put the product in rotation about the upstream end of said lateral surface, towards a downstream opening of said vortex chamber for supplying the dispensing orifice, said dispensing orifice having an outlet diameter which is equal to an internal diameter of said downstream opening.

2. The push-button according to claim 1, characterised in that the lateral surface has a conical geometry of revolution around the dispensing axis.

3. The push-button according to claim 1, characterised in that the upstream end has a cylindrical geometry of revolution wherein the downstream end of the at least one supply channel exits tangentially.

4. The push-button according to claim 1, characterised in that the internal diameter of the downstream opening is less than 50% of an internal diameter of the upstream end.

5. The push-button according to claim 4, characterised in that the internal diameter of the downstream opening is between 20% and 40% of the internal diameter of the upstream end.

6. The push-button according to claim 1, characterised in that the internal diameter of the downstream opening is less than or equal to 0.24 mm.

7. The push-button according to claim 1, characterised in that an axial length of the vortex chamber is at least equal to 80% of an internal diameter of the upstream end.

8. The push-button according to claim 7, characterised in that the axial length of the vortex chamber is between 90% and 200% of the internal diameter of the upstream end.

9. The push-button according to claim 1, characterised in that the downstream opening of the vortex chamber is surmounted by a dispensing orifice, said dispensing orifice having a cylindrical geometry of which an internal diameter is equal to the internal diameter of the downstream opening.

10. The push-button according to claim 9, characterised in that an axial length of the dispensing orifice is less than 50% of the internal diameter of said orifice.

11. The push-button according to claim 1, characterised in that the downstream end of the at least one supply channel forms a supply section of the vortex chamber, a surface area of said supply section being less than 10% of an interior surface area of the upstream end.

12. The push-button according to claim 11, characterised in that the surface area of the supply section of the vortex chamber is between 0.01 $mm^2$ and 0.03 $mm^2$.

13. The push-button according to claim 1, characterised in that the at least one supply channel is delimited between an exterior wall and an interior wall, the exterior wall being tangent to the upstream end and the interior wall being offset from the exterior wall by a distance less than 30% of an internal diameter of the upstream end.

14. The push-button according to claim 1, characterised in that the vortex unit has at least two supply channels of the vortex chamber, said at least two supply channels being arranged symmetrically in relation to a dispensing axis.

15. The push-button according to claim 1, characterised in that the spray nozzle has a proximal wall wherein is formed a print of the vortex unit and the anvil has a distal wall whereon the proximal wall of the nozzle is pressing against in order to delimit said vortex unit between them.

16. The push-button according to claim 1, characterised in that the dispensing path has an upstream annular conduit and a downstream annular conduit, said upstream and downstream annular conduits being in communication through the intermediary of at least one axial conduit, the at least one supply channel communicating with said downstream annular conduit.

17. A system for dispensing a product under pressure, comprising a system for sampling provided with the feed tube for the product under pressure whereon the well of the push-button according to claim 1 is mounted to make possible the spraying of the product.

* * * * *